US005436646A

United States Patent [19]

Schilling et al.

[11] Patent Number: 5,436,646

[45] Date of Patent: Jul. 25, 1995

[54] CAM OPERATED CUTTER FOR ROLL-FED PEN PLOTTERS

[75] Inventors: Don Schilling, Anaheim; Pat Nguyen, Diamond Bar, both of Calif.

[73] Assignee: CALCOMP Inc., Anaheim, Calif.

[21] Appl. No.: 64,236

[22] Filed: May 21, 1993

[51] Int. Cl.[6] ..... B41J 2/22

[52] U.S. Cl. ..... 346/139 R

[58] Field of Search ..... 346/139 R, 46, 29, 49, 346/140 R, 141

[56] References Cited

U.S. PATENT DOCUMENTS 4,614,952 9/1986 Nara et al. ..... 346/139 R 4,827,293 5/1989 Niemeyer ..... 346/139 R

*Primary Examiner*—Mark J. Reinhart

*Attorney, Agent, or Firm*—Wm F. Porter, Jr.; Robert M. Wallace

[57] ABSTRACT

In a pen plotter having a pen carriage moving laterally along a support beam over a plotting media, cutting apparatus for cutting the plotting media includes a first member carried by the pen carriage for lateral movement in combination therewith, a second member carried by the first member for movement perpendicular to movement of the first member between a first position adjacent the plotting media and a second position removed from the plotting media, a cutting blade carried by the second member for movement therewith such that when the second member is in the first position the cutting blade has a cutting edge thereof positioned to cut the plotting media and when the second member is in the second position the cutting edge does not contact the plotting media, a first abutting surface disposed adjacent one end of lateral movement of the pen carriage, a second abutting surface disposed adjacent an opposite end of lateral movement of the pen carriage, and a camming apparatus carried by the pen carriage and connected to the second member for moving the second member to the first position when a first end of the camming means is pushed against the first abutting surface by the pen carriage and for moving the second member to the second position when a second end of the camming means is pushed against the second abutting surface by the pen carriage.

11 Claims, 5 Drawing Sheets

CAM OPERATED CUTTER FOR ROLL-FED PEN PLOTTERS

BACKGROUND OF THE INVENTION

1. Technical Field

The invention is related to media cutting mechanisms for roll fed pen plotters.

2. Background Art

Pen plotters which plot on a media fed from a roll are known in the art. As depicted in FIG. 1, in such a plotter there is a plotting bed 10 over which the media 12 from the roll 14 is moved to create movement in one axis of the coordinate system of the plotter. A pen 16 is carried by a pen carriage 18 which moves laterally along a support beam 20 to create movement in the other axis of the coordinate system. At some point in the process, the portion of the media 12 containing the plot must be separated from the rest of the media 12 connected to the roll 14. This is typically accomplished by a cutting mechanism of the plotter in much the same way as roll-fed facsimile machines cut off individual pages, for example. Such a cutting mechanism 22 is depicted in simplified form in FIG. 2. The mechanism 22 comprises a moving carriage 24 carrying a cutting wheel 26. To cut the media 12, the carriage 24 is moved across the plotting bed 10 from one side to the other as indicated by the arrow 28. The cutting wheel 26 rolls across the media 12 and the sharp edge thereof cuts the media 12.

In devices such as facsimile machines which don't have a laterally moving member such as the pen carriage 18, the moving carriage 24 of the cutting mechanism 22 must be separate and separately powered. In a pen plotter, however, it is possible to mount the cutting wheel 26 to the pen carriage 18 as depicted in FIG. 3 and to employ the pen carriage 18 as the moving carriage 24 of the cutting mechanism 22. This approach, on the other hand, adds problems and considerations of its own. Since the pen carriage 18 is constantly in motion during the plotting process, some provision must be made to move the cutting wheel 26 out of the way during plotting and into a cutting position for cutting. The pen 16 is already carried by a lifting and lowering mechanism so that is not a problem or consideration. To accomplish this, a typical prior art approach would be to have the cutting wheel 26 mounted on a linkage 30 operated by an electrical solenoid 32. This, of course, adds substantially to the complexity of the construction of the pen carriage 18 which in turn adds to the cost of manufacture. It also adds substantial weight and mass to the pen carriage 18 which requires stronger components and can deteriorate the performance of the plotter due to the added time to overcome inertia of the greater mass when reversing direction of the pen carriage.

Wherefore, it is an object of the present invention to provide a cutting mechanism for roll-fed pen plotters which is carried by the pen carriage but which does not require an electrical solenoid for its operation.

It is another object of the present invention to provide a cutting mechanism for roll-fed pen plotters which is carried by the pen carriage and which is of low mass.

It is still another object of the present invention to provide a cutting mechanism for roll-fed pen plotters which is carried by the pen carriage and which is mechanically actuated.

Other objects and benefits of the invention will become apparent from the detailed description which follows hereinafter when taken in conjunction with the drawing figures which accompany it.

SUMMARY

The foregoing objects have been achieved by the invention in a pen plotter having a pen carriage moving laterally along a support beam over a plotting media. The invention is a cutting apparatus for cutting the plotting media and includes a first member carried by the pen carriage for lateral movement in combination therewith, a second member carried by the first member for movement perpendicular to movement of the first member between a first position adjacent the plotting media and a second position removed from the plotting media, a cutting blade carried by the second member for movement therewith such that when the second member is in the first position the cutting blade has a cutting edge thereof positioned to cut the plotting media and when the second member is in the second position the cutting edge does not contact the plotting media, a first abutting surface disposed adjacent one end of lateral movement of the pen carriage, a second abutting surface disposed adjacent an opposite end of lateral movement of the pen carriage, and a camming apparatus carried by the pen carriage and connected to the second member for moving the second member to the first position when a first end of the camming means is pushed against the first abutting surface by the pen carriage and for moving the second member to the second position when a second end of the camming means is pushed against the second abutting surface by the pen carriage.

The cutting apparatus can additionally include a bias apparatus for biasing the second member towards the first position. The cutting blade is typically a razor type knife blade. The first member can be a pair of parallel spaced sidewalls while the second member can be a box member disposed for sliding between the sidewalls. The cutting blade can have a cam slot while the box member has a ridge sized and shaped to fit into the slot whereby the razor type knife blade is removably carried by the box member. The camming apparatus includes a camming member bearing against the camming surface of the camming slot. The camming surface includes a pin disposed in the camming slot. The camming slot can consist of respective horizontal top and bottom slot portions connected by an angled slot portion. An upwardly extending bump on a bottom surface of the top horizontal portion near the angled slot portion prevents the blade from inadvertently dropping to the cutting position.

A pressure roller is mounted to and vertically moves with the second member, the pressure roller being adjacent the blade and in forcible contact with the media whenever the second member is in the first position. A pressure foot is mounted to and vertically moves with the second member, the pressure foot being adjacent the blade and in forcible contact with the media whenever the second member is in the first position.

DESCRIPTION OF THE PREFERRED EMBODIMENT

Figure 1:
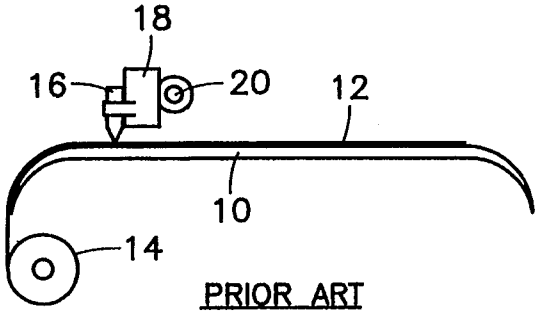
PRIOR ART FIG. 1
FIG. 1 is a simplified side view drawing of some elements of a prior art roll-fed pen plotter.
Figure 2:
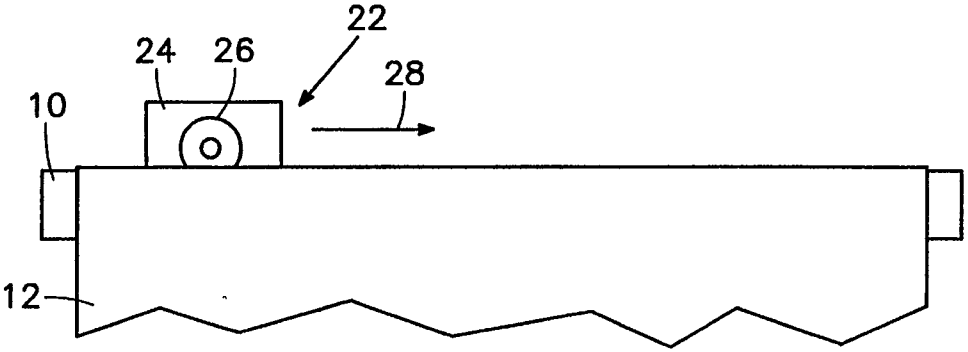
PRIOR ART FIG. 2
FIG. 2 is a simplified front view drawing of a prior art cutter mechanism for cutting roll-fed media.
Figure 3:
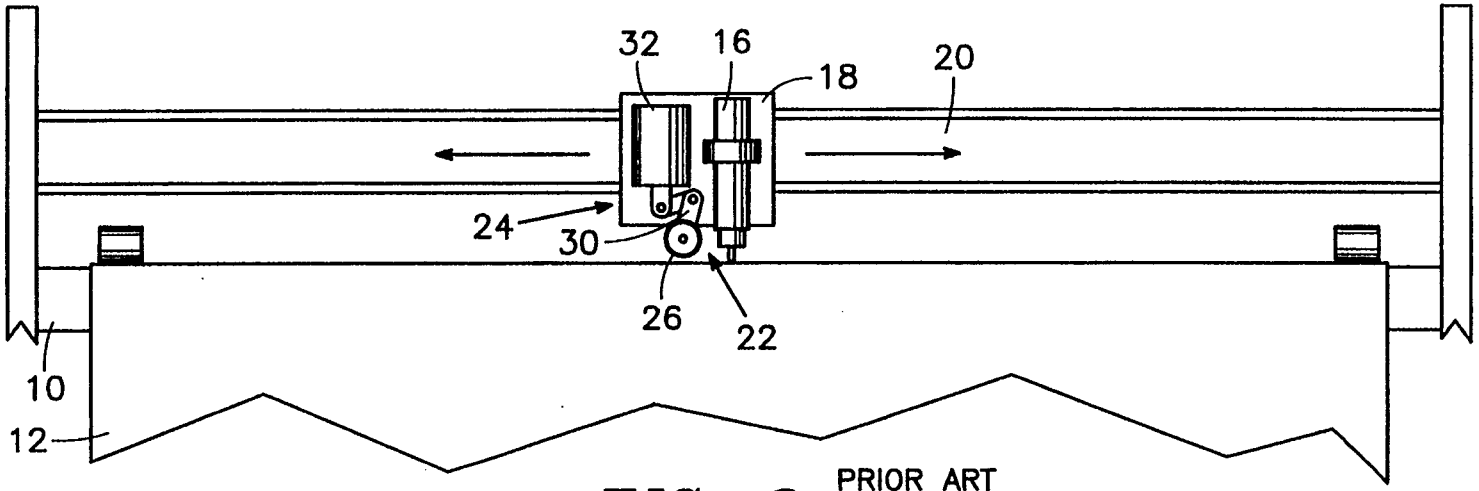
PRIOR ART FIG. 3
FIG. 3 is a more detailed front view drawing of a prior art approach to adding a cutting wheel to the pen carriage of a pen plotter.

As will be seen and appreciated from the description which follows hereinafter and the drawing figures which accompany it, the present invention meets its stated objectives by employing a cam operated cutting mechanism which utilizes a standard razor type cutting blade. Further, the cam member which raises and lowers the cutting blade is actuated by pushing extended ends thereof against the side walls of the plotter frame on the ends of the support beam carrying the pen carriage. Those skilled in the art will readily recognize and appreciate, however, that other approaches to moving the cam member could be employed within the scope and spirit of the present invention. Thus, the breadth accorded the claims which follow should not be limited by the use of a particular example and approach; but rather, they should be accorded a breadth in keeping with the scope and spirit of the disclosure contained herein.

Figure 4:
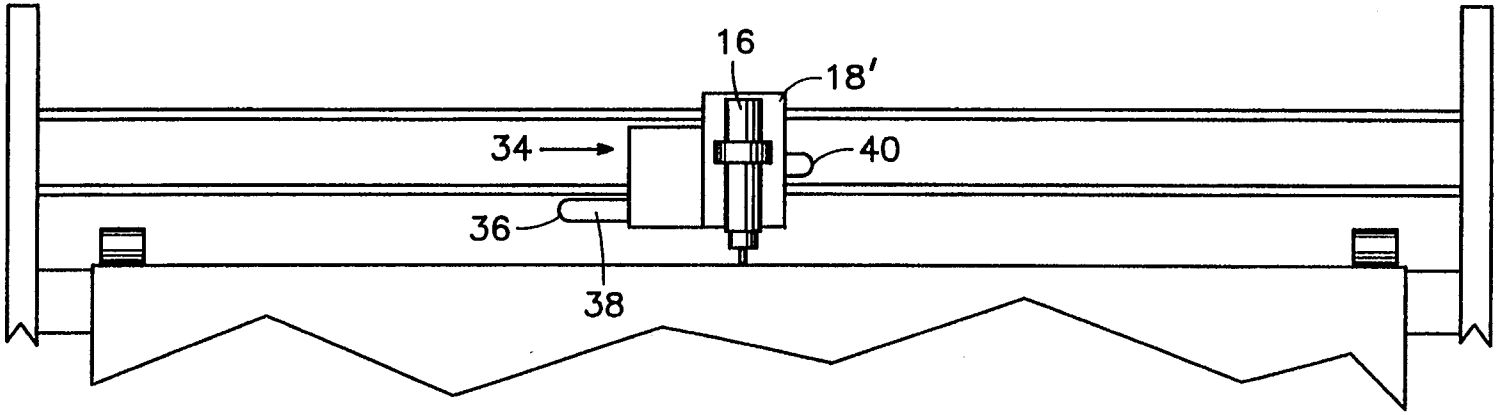
FIG. 4 is a front view drawing depicting the approach of the present invention for adding a cutting mechanism to the pen carriage of a pen plotter with the pen carriage in a plotting position and the cutter raised from its cutting position.

The foregoing manner of operation is depicted generally in FIGS. 4 through 7. In FIG. 4, we see the pen carriage 18′ which includes the cutter 34 of this invention in a plotting mode of operation with the cutting blade (not visible in this view) in a raised and retracted position. The left end 36 of a cam 38 is extended and the right end 40 of the cam 38 is retracted to effect this mode of the cutter 34.

Figure 5:
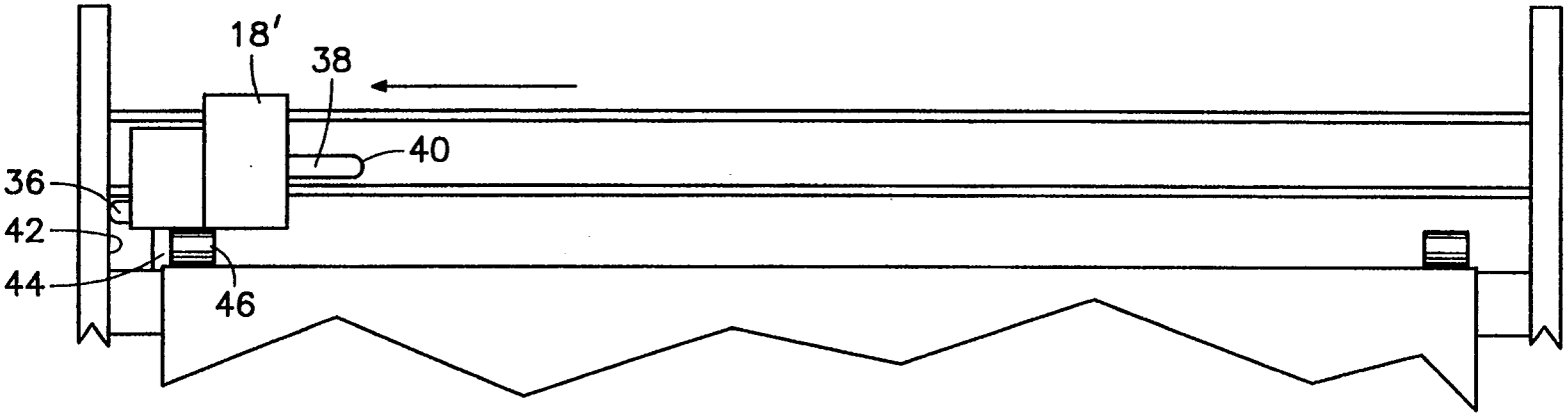
FIG. 5 shows the cutter-carrying pen carriage of FIG. 4 moved to the left to force the cam member to a cutter-lowering position with the pen removed from the carriage.
Figure 6:
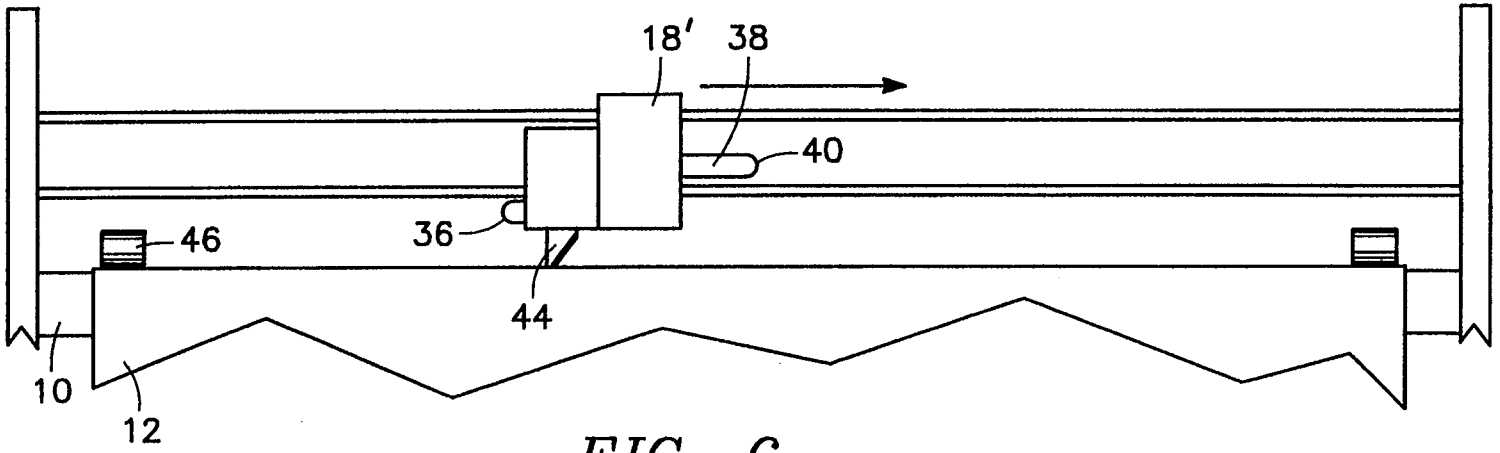
FIG. 6 shows the cutter-carrying pen carriage with its cutting blade in a lowered position moving across and cutting the media.
Figure 7:
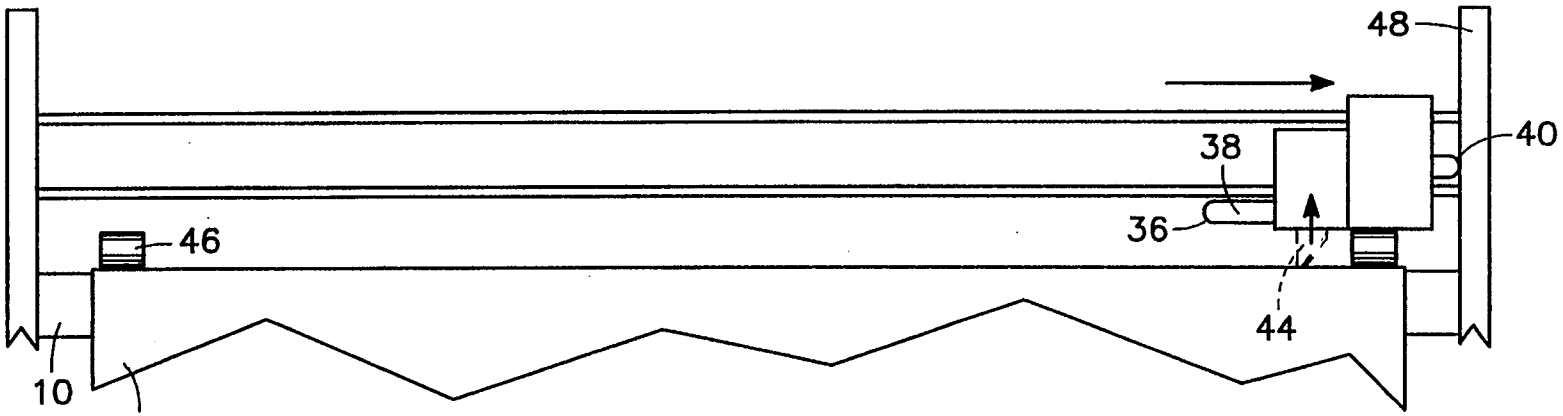
FIG. 7 shows the cutter-carrying pen carriage moved to the right to force the cam member to a cutter-raising position.

To cut the media, the plotter logic (not shown) causes the pen 16 to be removed from the carriage and returned to a multiple pen-holding turret (not shown). Then, the plotter logic moves the pen carriage 18′ all the way to the left as the drawing of FIG. 5 is viewed so as to force the left end 36 of the cam 38 into contact with the left sidewall 42 of the plotter frame (or some other suitable abutting surface). The pen carriage 18′ is further moved to the left until the cam 38 is fully moved to its right-most position within the cutter 34 as depicted in FIG. 5 thereby lowering the cutting blade 44. The pen carriage 18′ is then moved across the media 12 from left to right as depicted in FIG. 6 causing the blade 44 to cut the media 12. As the blade 44 finishes cutting the media 12, the pen carriage 18′ continues to move to the right causing the right end 40 of the cam 38 to contact the right sidewall 48 whereby the cam 38 is shifted to the left back to the blade-retracted position of FIG. 4 as the pen carriage 18′ is moved to the right by the plotter logic.

Figure 8:
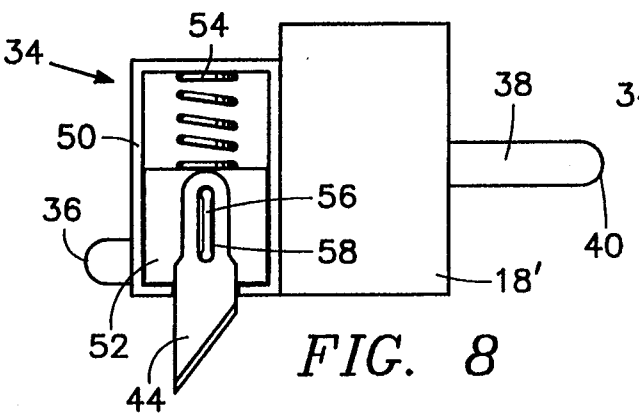
FIG. 8 is an enlarged drawing showing the manner in which a razor type cutting blade is carried by the pen carriage with the blade in its lowered position for cutting.

As depicted in FIG. 8, the cutter 34 of this invention is of simple and lightweight construction so that the added mass to the pen carriage 18′ is practically negligible. The cutter 34 comprises a box 50 of plastic slidably carrying a hollow plastic blade-carrying member 52 for vertical movement. The blade-carrying member 52 is biased towards the lowered position by a spring 54. As those skilled in the art will appreciate, the blade-carrying member 52 could be biased upward and the action of the cam 38 reversed, if desired; but, the approach shown is preferred because of a pressure roller to be described later which is a preferred addition to the cutter 34. The vertical face of the blade-carrying member 52 has a ridge 56 formed thereon sized and shaped to have the slot 58 of a commercially available razor type blade 44 fit thereover and be removably carried thereby. Other types of cutting blades could, of course, be employed and mounted accordingly; but, the use of an easily replaceable commercial blade is preferred for obvious reason of low cost and easy accessibility by users. Such blades are sold under tradenames such as XACTO for model building and similar activities.

Figure 10:
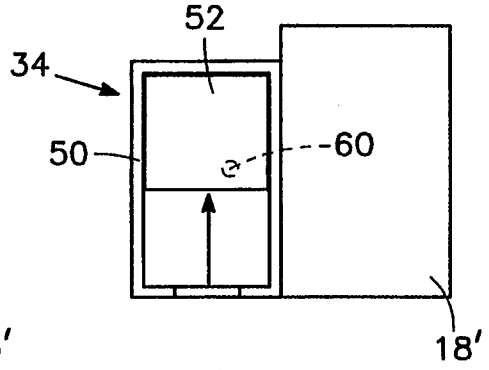
FIG. 10 is a simplified drawing of the pen carriage with the blade carrying member in its raised position.
Figure 9:
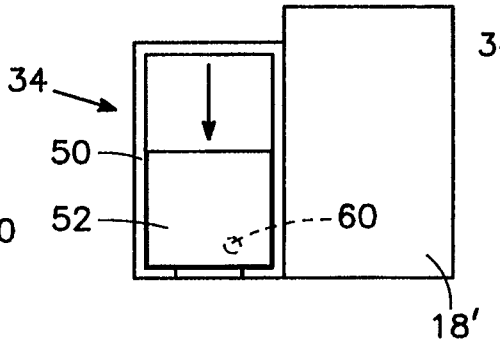
FIG. 9 is a simplified drawing of the pen carriage with the blade carrying member in its lowered position.
Figure 11:
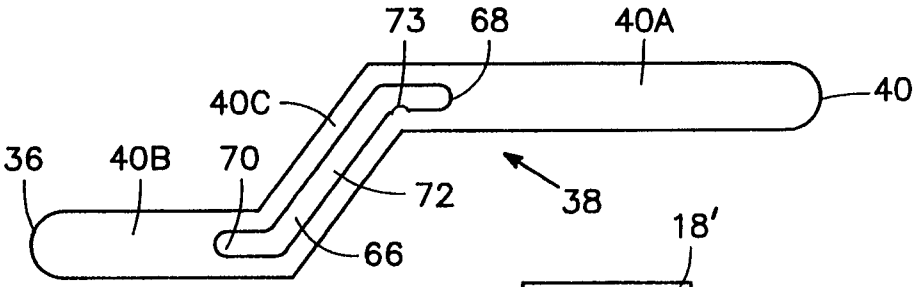
FIG. 11 is a detailed drawing of the cam member employed in the present invention.
Figure 12:
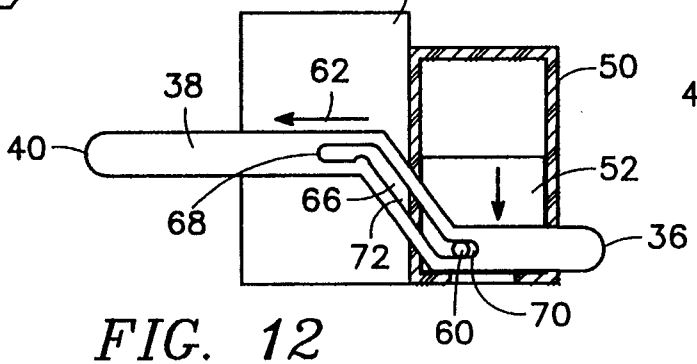
FIG. 12 is a simplified, partially cut-away, rear view drawing of the pen carriage with the cam member positioning the blade-carrying member in its lowered position.
Figure 13:
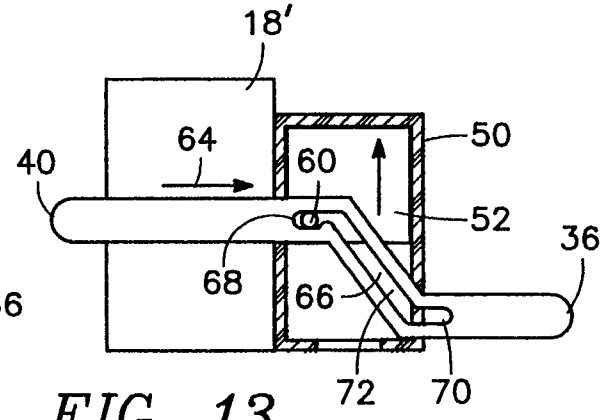
FIG. 13 is a simplified, partially cut-away, rear view drawing of the pen carriage with the cam member positioning the blade-carrying member in its raised position.

The blade-carrying member 52 is moveable between the lowered position of FIG. 9 and the raised position of FIG. 10. This is accomplished by the cam 38 of FIG. 11 acting on the pin 60 shown indicated by dashed lines in FIGS. 9 and 10. The way in which the cam 38 does this is depicted in greater detail in FIGS. 12 and 13. The cam 38 includes horizontal top and bottom portions 40A, 40B connected by an angled portion 40C. The cam 38 is, of course, supported by the structure of the pen carriage 18′ and cutter 34 for lateral sliding movement as depicted by the arrows 62 and 64 of FIGS. 12 and 13, respectively. Such aspects will be readily apparent to those skilled in the art and will depend on the construction of the particular pen plotter into which the present invention is being incorporated and, therefore, they are not shown herein in the interest of simplicity. Most typically, the cam 38 would be supported by support slots, ridges, and the like, formed into the plastic of the overall assembly. The cam 38 contains a camming slot 66 in which the pin 60 rides. The camming slot 66 consists of horizontal top and bottom slot portions 68, 70, respectively, connected by an angled slot portion 72. As the cam 38 is moved from right to left as depicted in FIG. 12, the pin 60 is forced to follow a horizontal path along the top slot portion 68 and then a downward moving path along the angled slot portion 72, leading the pin 60 into the slot portion 70. As the cam 38 is moved from left to right as depicted in FIG. 13, the process is reversed and the pin 60 is raised (along with the blade-carrying member 52 from which it extends) as the pin is forced along the camming path extending from the bottom end 70 through the connecting portion 72, past a raised rounded bump 73 and into the top end 68. The raised rounded bump 73 extends upwardly from the bottom surface of the top horizontal slot portion 68 at its juncture with the angled slot portion 72. Once the button 60 passes the bump 73 into the horizontal slot portion 68, the button prevents the cam 38 from inadvertently sliding out of the raised position of FIG. 13.

Thus, it should be appreciated from the foregoing description that the cutter 34 of the present invention is simple and inexpensive to construct and is extremely lightweight since the components are all of hollow plastic except for the spring 54 and blade 44, which would typically be of steel; but, of such small size as to add virtually no weight. Also, it should be recognized and appreciated that the additions to the logic and circuitry of the plotter to incorporate the present invention are minimal. Being mechanically operated, there is no wiring to a solenoid which must be connected and no switching of the power to the solenoid which must be accomplished by the plotter logic. All that is required is that the plotter logic move the pen carriage 18' further in its normal directions to mechanically actuate the cutting mechanism of the cutter 34 and then retract it. Having thus described the basic cutter 34 of this invention, two preferred additions thereto will now be described.

Figure 15:
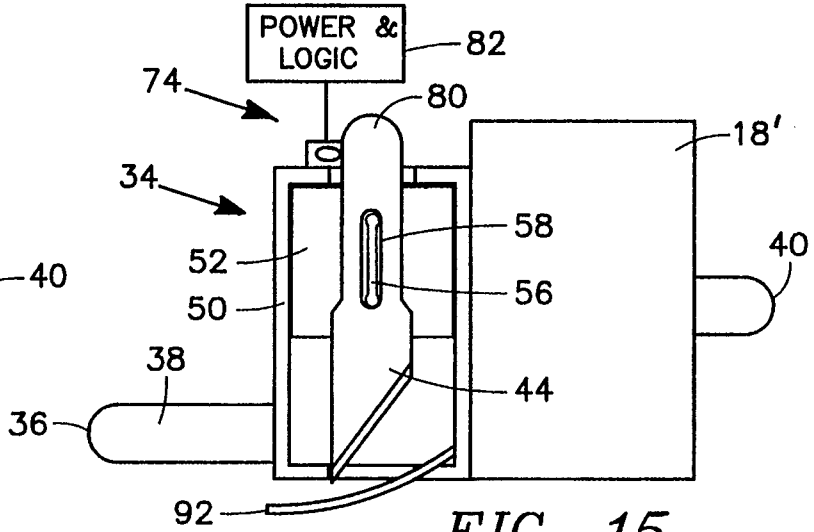
FIG. 15 is a simplified partial functional block diagram drawing showing the blade sensing apparatus and logic of FIG. 14 sensing the presence of a blade in the raised position.
Figure 14:
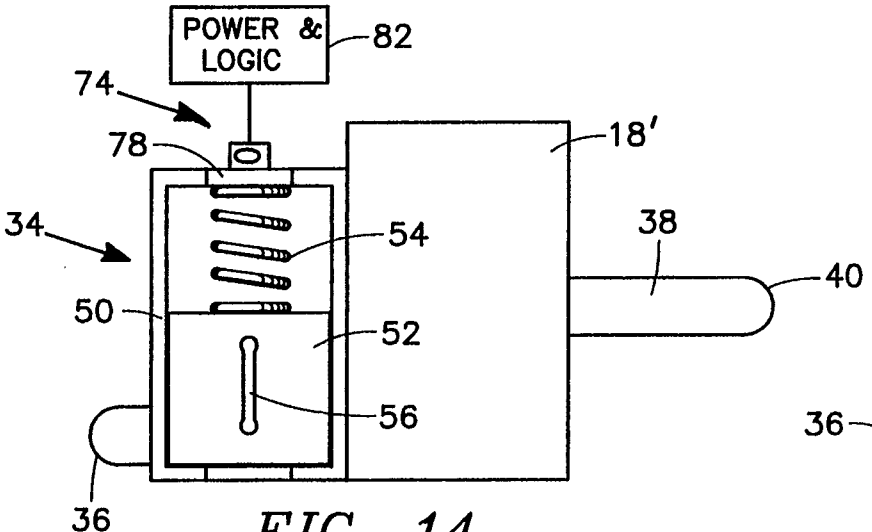
FIG. 14 is a simplified partial functional block diagram drawing showing the addition of blade sensing apparatus and logic to the present invention.

The first preferred addition is depicted in FIGS. 14 and 15. As depicted in FIG. 14, an optical source/sensor 74 emits a light beam which is reflected whenever the blade 44 is in the raised position of FIG. 13. The optical source/sensor 74 detects light reflected back from the blade 44 whenever the blade 44 is in the raised position. The optical source/sensor 74 is positioned at the top of the box 50 above which the top 80 of the blade 44 extends when the blade-carrying member 52 is in its raised position as depicted in FIG. 15. The optical sensor 74 is connected to power & logic module 82 which is part of the plotter's logic and electronics. When the blade 44 is present and in its raised position, light from the optical source/sensor 74 is reflected by the top 80, the reflected light being sensed by the optical source/sensor so that it sends an "on" signal to the power & logic module 82. Thus, by monitoring the optical source/sensor output, the plotter logic learns two things—whether a blade 44 is present and whether it is raised. Thus, the plotter can be prevented from plotting if the blade 44 is present and can be prevented from attempting to cut if there is no blade 44 present. Since operation is mechanical, the plotter logic attempts to determine such facts by moving the pen carriage 18' to raise the blade-carrying member 52 and then rechecking the output from the optical sensor 74.

Figure 17:
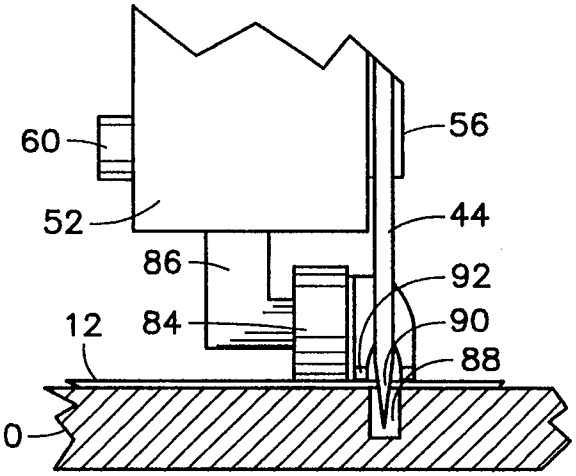
FIG. 17 is an enlarged and partially cutaway drawing showing how the media holding roller of FIG. 16 works.
Figure 16:
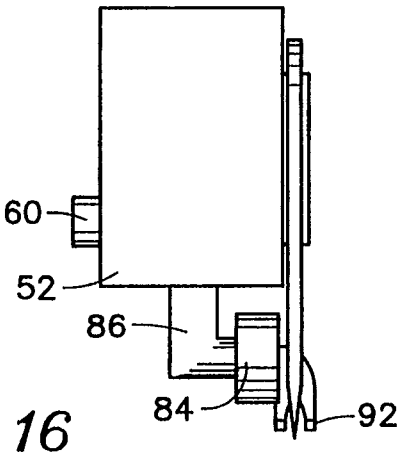
FIG. 16 is an enlarged side view drawing of a pen carriage according to the present invention with the addition of a media holding roller adjacent the cutting blade and a pressure foot.

The second preferred addition is depicted in FIGS. 16 and 17 and is directed to holding the media 12 against movement during cutting. This is accomplished by adding a pressure roller 84 to the bottom of the blade-carrying member 52 on a connecting arm 86. The pressure roller 84 is mounted to the arm 86 for rotation. As depicted in FIG. 17, the plotting bed 10 of the plotter typically has a slot 88 into which a cutting wheel or blade extends through the media 12 so as to prevent damage to either surface. The pressure roller 84 is disposed behind and slightly above the cutting edge 90 of the blade 44 so that it rolls along and urges the media 12 against the top surface of the plotting bed 10 as the blade 44 moves along the slot. The roller 84 adds pressure to exert a sufficient holding force on the media to ensure smooth cutting. The reason for preferring to spring bias the blade-carrying member 52 towards its lowered position can now be appreciated as the biasing action tends to hold the pressure roller 84 against the media 12. A related preferred feature is a pressure foot 92 illustrated in FIGS. 15 and 16. The pressure foot 92 is mounted to the blade-carrying member 52 and moves down therewith to better hold the media against the plotting bed 10 during cutting.

Wherefore, having thus described the invention, what is claimed is:

1. In a pen plotter having a pen carriage moving laterally along a support beam over a plotting media, cutting apparatus for cutting the plotting media comprising:

a) a first member carried by the pen carriage for lateral movement in combination therewith;

b) a second member carried by said first member for movement perpendicular to movement of said first member between a first position adjacent the plotting media and a second position removed from the plotting media;

c) a cutting blade carried by said second member for movement therewith such that when said second member is in said first position said cutting blade has a cutting edge thereof positioned to cut the plotting media and when said second member is in said second position said cutting edge does not contact the plotting media;

d) a first abutting surface disposed adjacent one end of lateral movement of the pen carriage;

e) a second abutting surface disposed adjacent an opposite end of lateral movement of the pen carriage; and, f) camming means carried by the pen carriage and connected to said second member for moving said second member to said first position when a first end of said camming means is pushed against said first abutting surface by the pen carriage and for moving said second member to said second position when a second end of said camming means is pushed against said second abutting surface by the pen carriage.

2. The cutting apparatus for a pen plotter of claim 1 and additionally comprising:

bias means for biasing said second member towards said first position.

3. The cutting apparatus for a pen plotter of claim 1 wherein:

said cutting blade is a razor type knife blade.

4. The cutting apparatus for a pen plotter of claim 1 wherein:

a) said first member comprises a pair of parallel spaced sidewalls; and, b) said second member comprises a box member disposed for sliding between said sidewalls.

5. The cutting apparatus for a pen plotter of claim 4 wherein:

a) said cutting blade is a razor type knife blade having a slot therein; and, b) said box member has a ridge sized and shaped to fit into said slot whereby said razor type knife blade is removably carried by said box member.

6. The cutting apparatus for a pen plotter of claim 1 wherein:

a) said second member carries a camming surface; and, b) said camming means comprises a camming member bearing against said camming surface.

7. The cutting apparatus for a pen plotter of claim 6 wherein:

a) said camming member includes a camming slot; and, b) said camming surface comprises a pin disposed in said camming slot.

8. The cutting apparatus of claim 7 wherein said camming slot comprises respective horizontal top and bottom slot portions connected by an angled slot portion.

9. The cutting apparatus of claim 8 further comprising an upwardly extending bump of a bottom surface of said top horizontal portion near said angled slot portion.

10. The cutting apparatus of claim 1 further comprising a pressure roller mounted to and vertically movable with said second member, said pressure roller being adjacent said blade and in forcible contact with said media whenever said second member is in said first position.

11. The cutting apparatus of claim 10 further comprising a pressure foot mounted to and vertically movable with said second member, said pressure foot being adjacent said blade and in forcible contact with said media whenever said second member is in said first position.

* * * * *